US005702201A

United States Patent [19]

Macku et al.

[11] Patent Number: 5,702,201

[45] Date of Patent: Dec. 30, 1997

[54] METHOD FOR COMPENSATING DIFFERENTIAL COMPACTION IN AN ASPHALT PAVING MAT

[75] Inventors: Charles G. Macku, Cedar Rapids, Iowa; Alan W. Boyles, Grand Junction, Colo.

[73] Assignee: Cedarapids, Inc., Cedar Rapids, Iowa

[21] Appl. No.: 679,695

[22] Filed: Jul. 11, 1996

Related U.S. Application Data

[63] Continuation of Ser. No. 529,147, Sep. 15, 1995, Pat. No. 5,599,134.

[51] Int. Cl.[6] ..... E01C 19/48

[52] U.S. Cl. ..... 404/75; 427/138

[58] Field of Search ..... 404/84.05, 84.1, 404/84.2, 84.5, 75; 427/138

[56] References Cited

U.S. PATENT DOCUMENTS

| | | | |
|---|---|---|---|
| 3,749,504 | 7/1973 | Smith | 404/84.2 |
| 3,771,892 | 11/1973 | Munyon et al. | 404/84.1 |
| 3,846,035 | 11/1974 | Davin | 404/84.1 |
| 3,879,149 | 4/1975 | Smith et al. | 404/84.1 X |
| 5,201,604 | 4/1993 | Ferguson et al. | 404/84.5 X |
| 5,301,170 | 4/1994 | James | 367/188 |
| 5,362,177 | 11/1994 | Bowhall et al. | 404/84.1 |
| 5,393,167 | 2/1995 | Fujita et al. | 404/84.1 |
| 5,599,134 | 2/1997 | Macku et al. | 404/84.1 |

*Primary Examiner*—James Lisehora
*Attorney, Agent, or Firm*—Donald R. Schoonover

[57] ABSTRACT

A method for compensating differential compaction in an asphalt paving mat wherein an asphalt paver has a compaction compensating system that includes a nominal reference, such as an elongate averaging ski, for determining the general profile of the underlying terrain on which a mat of asphalt material is being placed by the paver and a compensating ski for determining localized irregularities of the subgrade and a control system for responsively altering the thickness of the mat being placed by the paver to compensate for differential compaction of the asphalt material such that a generally planar asphalt paving surface is obtained after compaction thereof. Variations of the method include using a stringline for the reference and/or one or two non-contacting sensors for communicating the general profile and localized irregularity determinations of the subgrade to the control system.

17 Claims, 3 Drawing Sheets

Fig.1.
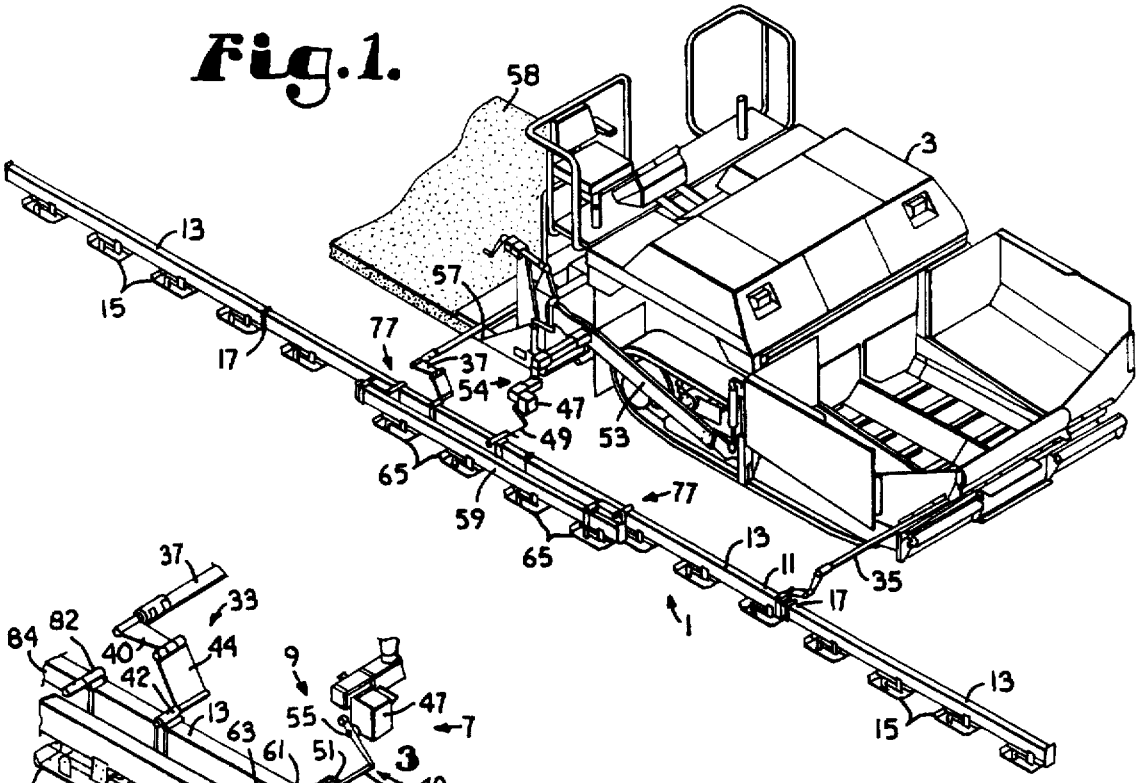
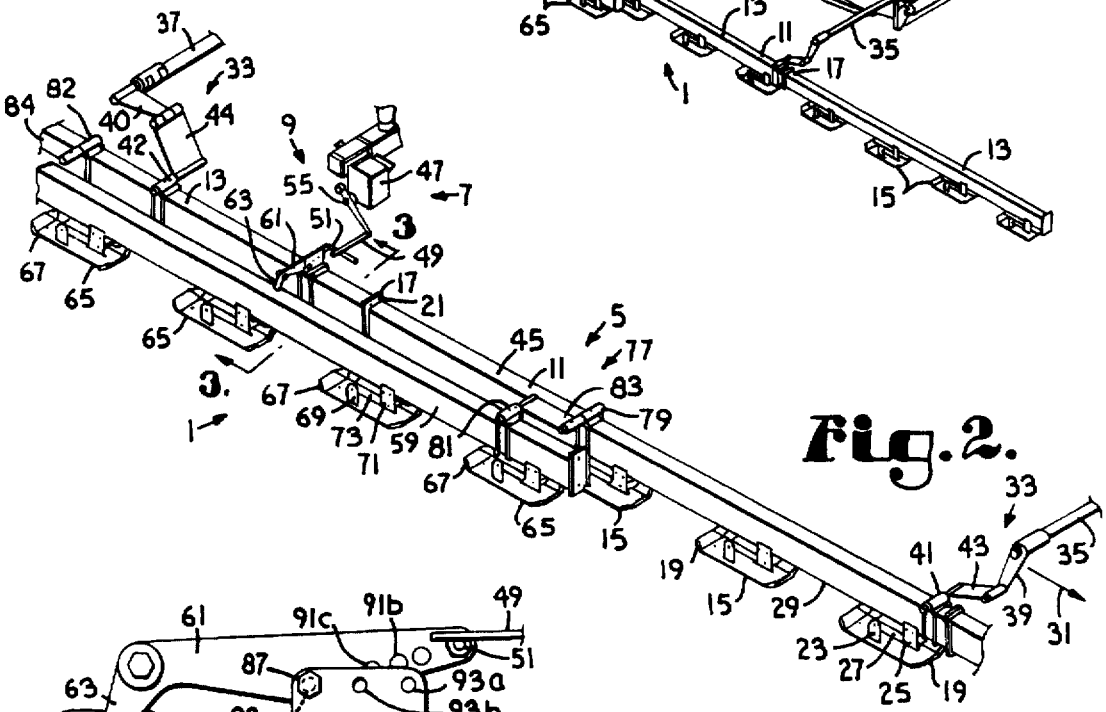
Fig.2.
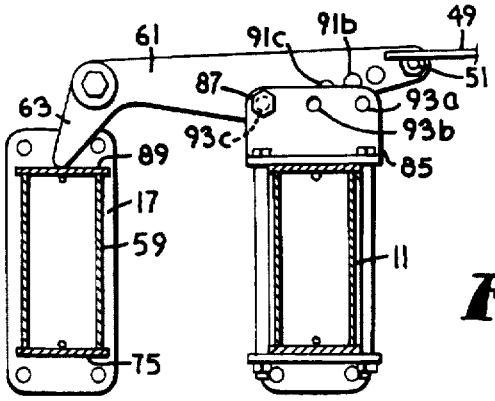
Fig.3.

Fig.6.
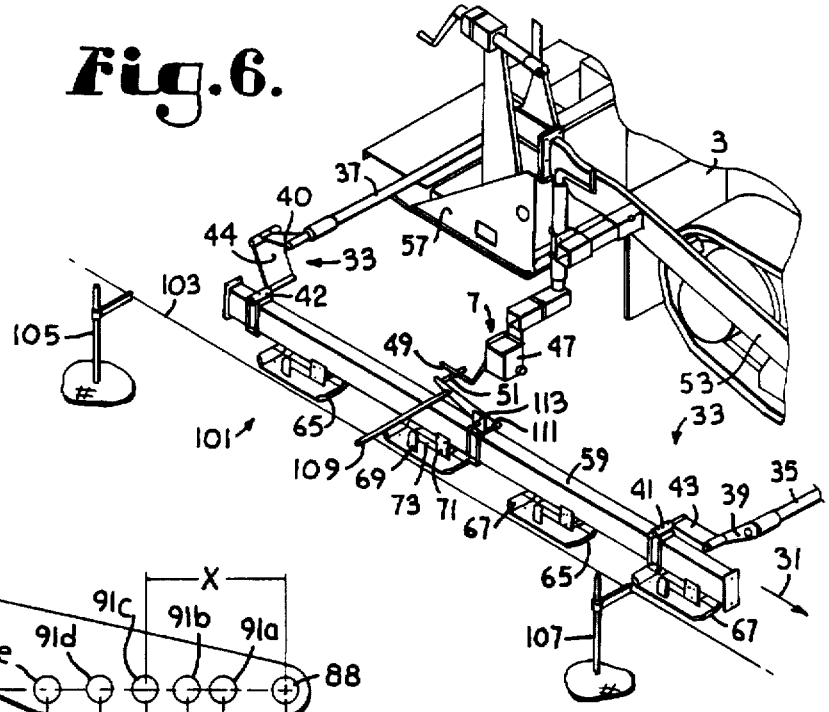
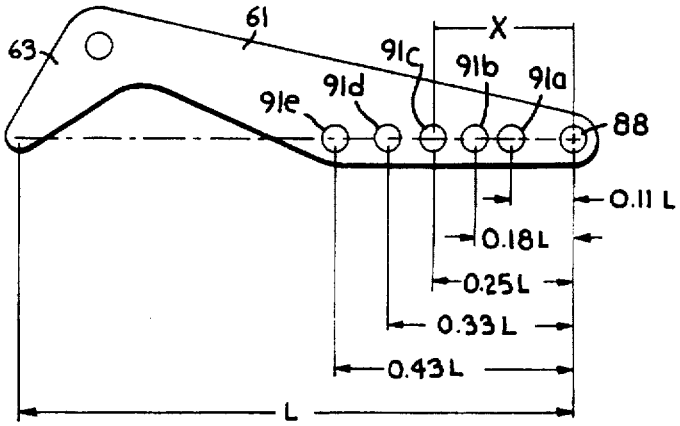
Fig.4.
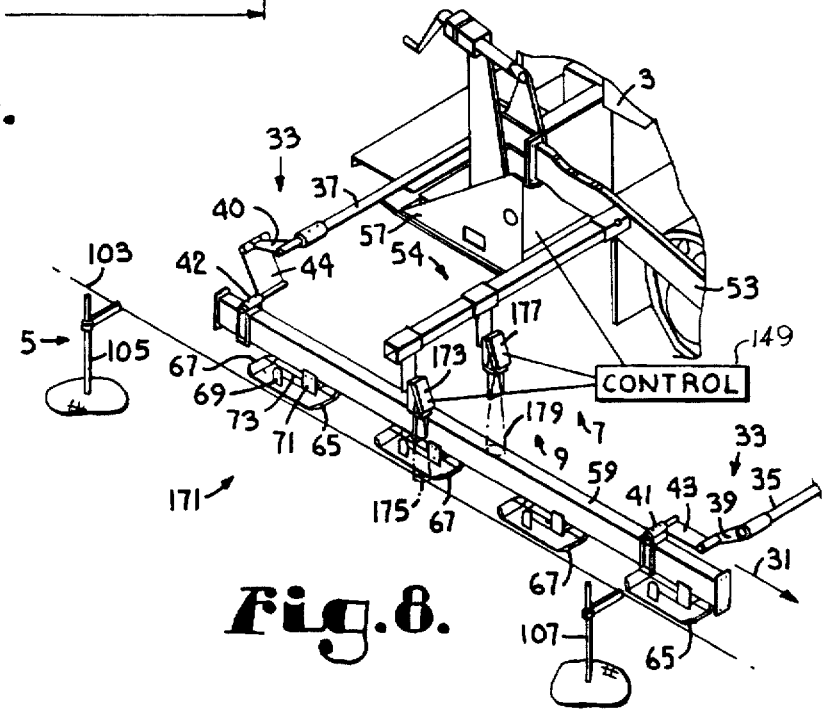
Fig.8.

Fig. 5.
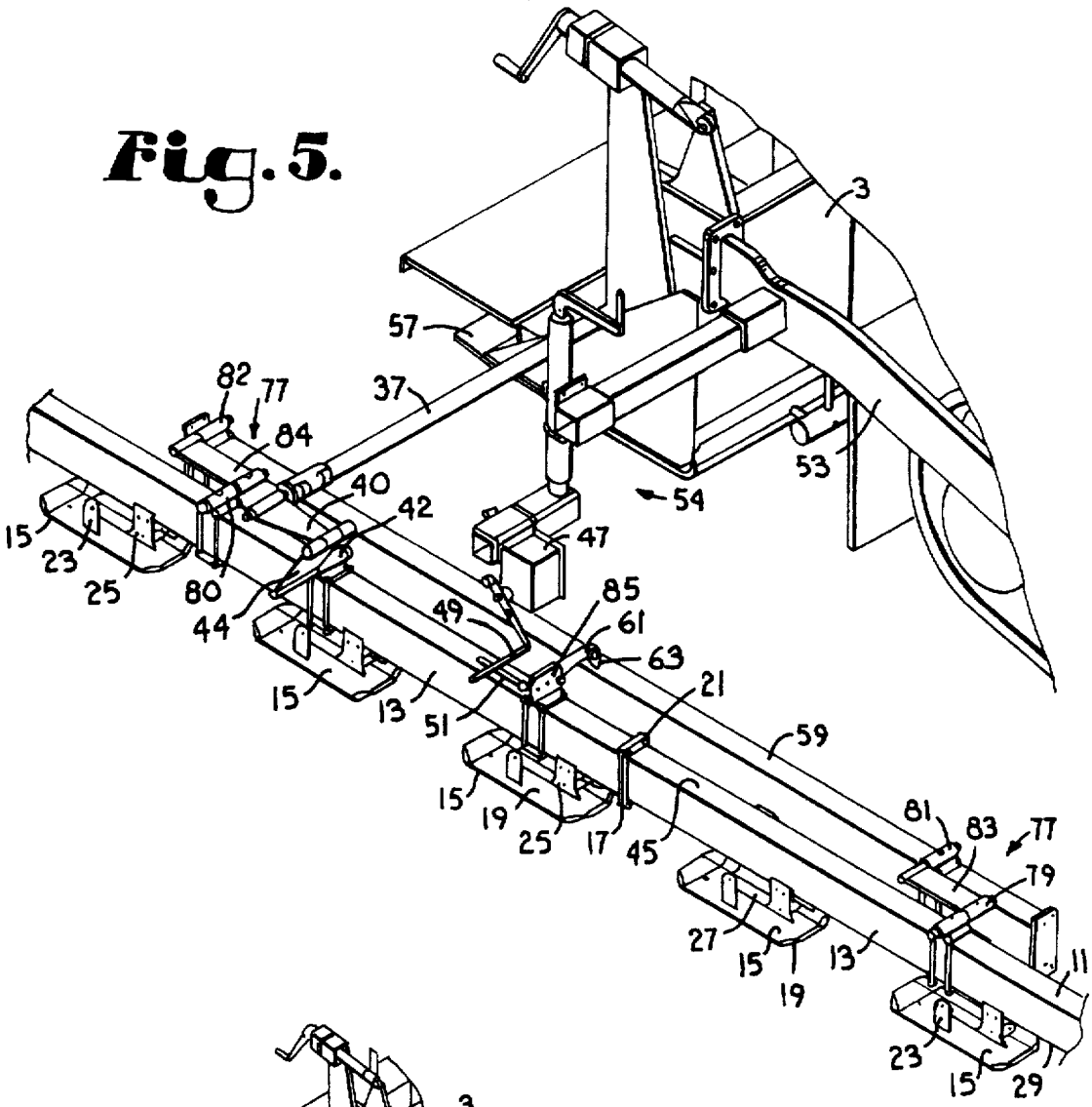
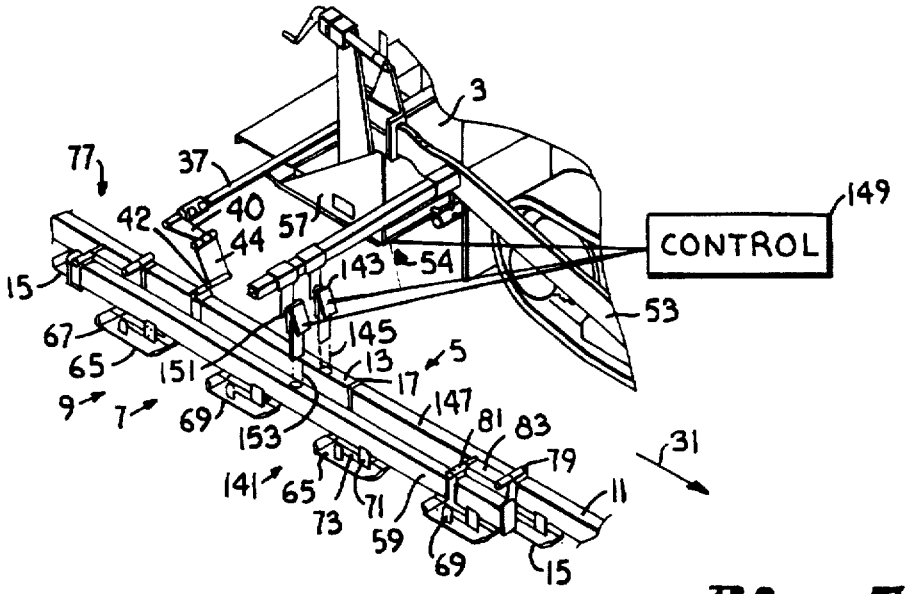
Fig. 7.

METHOD FOR COMPENSATING DIFFERENTIAL COMPACTION IN AN ASPHALT PAVING MAT

This application is a continuation of application for U.S. patent Ser. No. 08/529,147, filed 15 Sep. 1995, now U.S. Pat. No. 5,599,134, issued 4 Feb. 1997.

BACKGROUND OF THE INVENTION

Various types of equipment are used to provide hard surfaces for streets, highways, parking lots, etc. Included among that array of equipment is an asphalt paver, which utilizes a screed to place a layer or mat of asphalt material on an underlying subgrade. Preferably, asphalt paving has a substantially planar surface in order to provide a smooth ride for vehicles subsequently passing thereover. Thus, other than perhaps for following the gradual curvature of the underlying terrain and for intentional "crowning" for encouraging drainage of surface water from the finished surface, the mat placed by the paver has a substantially planar surface. After the paver places a mat of asphalt material on the subgrade, a heavy roller is used to compact the asphalt material in order to provide a durable, non-porous surface. Ideally, the underlying subgrade also has a correspondingly substantially planar surface.

After the mat is placed by the paver, the mat is compacted with a heavy roller, which compresses the asphalt material to a factor of the thickness of the mat as laid by the paver. If the asphalt material has a uniform density and thickness, which is greater than a certain minimum thickness relative to the size of the aggregate contained in the asphalt material, then the actual thickness of the asphalt mat after compaction depends on the thickness of the asphalt material prior to compaction by the roller. The ratio between (a) the difference in thickness of the mat before and after compaction with the roller, and (b) the thickness of the asphalt mat as placed, is commonly referred to as the "compaction factor".

If the underlying subgrade and the asphalt material mat are both planar and if the asphalt material has a uniform density, then the rolled surface will also be planar, as desired. In an actual situation, however, the surface of the underlying subgrade generally has depressions and elevations that cause the surface of the compacted mat to vary substantially from a planar profile. Thus, the asphalt material mat, even though having a substantially planar surface as laid by the asphalt paver, is thicker is some places than in others. As a result, the asphalt, after compaction, no longer exhibits the substantially planar surface but, instead, has depressions and elevations similar to, but less pronounced than, those of the subgrade surface. This uneven result is sometimes referred to as "differential compaction".

For example, assume that the desired thickness of asphalt material nominally laid by a paver prior to compaction is six inches. Assume also that the subgrade has a local depression that is two inches deep and a ridge or local elevation that is two inches high. Thus, the thickness of the asphalt material laid by the paver would be eight inches deep over the local depression and only four inches deep over the local elevation. Assume further that the roller compacts the asphalt material to seventy-five percent of its original thickness as laid by the paver, or a reduction in thickness of twenty-five percent. After compaction by the roller, the thickness of the asphalt material over the substantially planar surface of the subgrade would be four and one-half inches.

Similarly, the thickness of the compacted asphalt material over the depression and the localized elevation would be six inches and three inches, respectively. In other words, the surface of the asphalt mat that was substantially planar, as provided by the paver prior to compaction by a roller, now has a surface over the depression that lies one-half inch below the surface of the nominal mat. Further, the surface of the compacted asphalt mat over the local elevation lies one-half inch above the surface of the compacted nominal mat and one-inch above the surface of the compacted mat above the depression. Such a situation obviously does not provide a smooth ride for a vehicle passing thereover.

In an attempt to compensate for such undesirable surface irregularities, many prior art pavers utilize a grade reference system, typically having a length of thirty to fifty feet and generally referred to as a "ski" or "averaging ski", wherein the surface deviations in the underlying subgrade in the direction of travel of the paver, sometimes referred to as longitudinal surface deviations, are averaged over the length of the ski.

Although most of the descriptions herein refer to the use of an averaging ski, it should be understood that a stringline or an existing surface, such as an abutting layer of asphalt paving for "joint matching", may be used in place of an averaging ski and the operating principle remains basically the same.

The averaging ski may be multi-footed, i.e., have several supporting feet gliding along and bearing generally against the underlying subgrade to establish an average reference for the nominal depth of asphalt material to be deposited thereon. In fact, dynamic positioning of the reference surface of the averaging ski may largely depend on the two highest relative points of the subgrade which two of the feet bear against at any given time.

Due to the leveling action of the screed in combination with the averaging ski, the paver can lay a relatively uniform mat over a subgrade having longitudinal deviations with periods on the order of, or greater than, the length of the averaging ski. Minimal perturbations, such as those arising from an exposed rock in the subgrade, can sometimes be compensated for by the spring loading of individual shoes supporting the averaging ski.

Unfortunately, however, the effects of many of the longitudinal subgrade deviations have periods that are less than the length of the averaging ski and, therefore, cannot be removed by use of prior art averaging skis. In other words, due to differential compaction, many of the localized deviations may be reduced in magnitude but, nevertheless, are still present after compaction of asphalt laid by a paver utilizing a prior art averaging ski.

A common practice currently utilized to minimize the effects of localized deviations is to place one or more leveling courses, or "lifts", to remove the low spots, or to use cold milling to remove the high spots. In either case, the goal is to lessen or remove the deviations before placing the topping or finishing surface mat of asphalt paving material. In other words, each successive layer more closely approximates the ideal subgrade.

What is needed, therefore, is an apparatus and method which takes proper account of differential compaction when placing asphalt paving material and which thereby reduces or eliminates the extra leveling courses normally required to remove the effects of localized deviations in an asphalt paving subgrade.

SUMMARY OF THE INVENTION

An improved asphalt paver system is provided for compensation of differential compaction in a mat laid by the asphalt paver such that the mat will have a generally planar surface after compaction thereof. One embodiment of the system includes an elongate, multi-footed averaging ski, towed by the paver, that determines the general profile of the subgrade being paved; a multi-footed compensating ski, towed by the paver or the averaging ski, that determines the vertical and longitudinal extent of localized irregularities in the subgrade, relative to the general subgrade profile, in the direction of travel of the paver; and a control system that adjusts the pull point of a screed of the paver and thereby adjusts the thickness of the mat in response to the changes in elevation of the averaging ski and to changes in elevation of the compensating ski relative to those of the averaging ski such that differential compaction is substantially eliminated from the mat after compaction thereof.

Modified embodiments include a system utilizing a stringline instead of an averaging ski to determine the general profile of the subgrade; or a pair of non-contacting sensors in conjunction with either an averaging ski and a compensating ski, or in conjunction with a stringline and a compensating ski.

OBJECTS AND ADVANTAGES OF THE INVENTION

Therefore, the principal objects and advantages of the present invention include: providing a system that includes a device for determining localized deviations of a subgrade receiving a mat of asphalt material from a paver; providing such a system that compensates for differential compaction of a mat being laid by an asphalt paver; providing such a system that can be used for a single strip of paving or for more than one strip of paving being laid side by side, such as for joint matching; providing such a system that reduces or eliminates extra leveling courses normally required to remove the effects of localized deviations in an asphalt paving subgrade; providing such a system that can be used with a stringline in lieu of an averaging ski; providing such a system that can be used with a non-contact sensing device, such as an ultrasonic sensor; providing such a system that can be used with a stringline in combination with a non-contact sensor and a compensating ski; and generally providing such a system that is relatively simple and easy to use, maintain, and operate efficiently and reliably, and that generally performs the requirements of its intended purposes.

Various objects, features and advantages of this invention will become apparent from the following description taken in conjunction with the accompanying drawings, which constitute a part of this specification and which set forth, by way of illustration, certain exemplary embodiments of this invention.

BRIEF DESCRIPTION OF THE DRAWINGS

FIG. 1 is a perspective view of a paver with a compaction compensating system, according to the present invention.

FIG. 2 is an enlarged and fragmentary, perspective view of the compaction compensating system showing an averaging ski and a compensating ski spaced outwardly from the averaging ski.

FIG. 3 is a further enlarged and fragmentary, partially cross-sectional view of the compaction compensating system, taken along line 3—3 of FIG. 2, showing a differential grade elevation sensor.

FIG. 4 is an enlarged, side elevational view of a camshaft of the compaction compensating system.

FIG. 5 is a fragmentary, perspective view of the compaction compensating system, enlarged with respect to FIG. 2, but showing the compensating ski spaced inwardly from the averaging ski, according to the present invention.

FIG. 6 is a fragmentary, perspective view of a first modified embodiment of the compaction compensating system, showing a compensating ski being used in conjunction with a stringline, according to the present invention.

FIG. 7 is a fragmentary, perspective view of a second modified embodiment of the compaction compensating system, showing an averaging ski and a compensating ski being used in conjunction with a pair of non-contacting sensors, according to the present invention.

FIG. 8 is a fragmentary, perspective view of a third modified embodiment of the compaction compensating system, showing a compensating ski and a stringline being used in conjunction with a pair of non-contacting sensors, according to the present invention.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The present invention comprising a compaction compensating system 1 and an asphalt paver 3 modified thereby, exemplarily shown in FIGS. 1 through 5, can be generally described as a mobile grade placement system, which compensates for differential compaction caused by localized deviations in an asphalt paving subgrade. The system 1 includes surface reference means 5, surface control means 7, and compaction compensating means 9.

The surface reference means 5 include an averaging ski 11 that is generally comprised of a plurality of ski sections 13. Each of the ski sections 13 is mounted on two or more sliding or rolling ski supports 15, such as the multi-footed arrangement shown in FIG. 1. For example, each of the ski sections 13 may have four of the ski supports 15 and a length of approximately ten feet.

Each of the ski sections 13 has an end bracket 17 at each end thereof such that the ski sections 13 can be connected end-to-end, such as by bolts and nuts 21 or the like. The averaging ski 11 shown in FIG. 1 has four of the ski sections 13 connected together providing an overall length of approximately forty feet for the averaging ski 11. After completion of a project, the ski sections 13 may be disconnected from each other, thereby providing a shorter, more manageable length for moving the averaging ski 11 from site to site.

Each of the ski supports 15 shown in FIG. 2 has a shoe 19, a pair of opposing shoe brackets 23 attached to the shoe 19, a pair of opposing support brackets 25 attached to a respective one of the ski sections 13, and an offset portion 27 pivotally connected near each end thereof to either the pair of shoe brackets 23 or the pair of support brackets 25, as shown in FIG. 5.

Each of the ski supports 15 is spring loaded (not shown), which permits the shoe 19 thereof to be generally vertically displaced between upper and lower limiting stops (not shown). Normally, each of the shoes 19 is biased downwardly a selected distance from a bottom 29 of the respective ski section 13 against the respective lower limiting stop thereof.

As a single one of the ski supports 15 encounters a localized irregularity in the subgrade, such as an exposed rock or the like, the perturbed ski support 15 is urged upwardly toward the upper limiting stop against the aforesaid downward bias. If the spacing between the upper and lower limiting stops is greater than the mount of displacement of the perturbed ski support 15 caused by the localized irregularity, then the perturbation affects only the perturbed ski support 15 and does not affect the averaging effect of the averaging ski 11 as the downward biasing of a single one of the ski supports 15 is insufficient to affect the elevation of the averaging ski 11.

If, however, the amount of displacement of the perturbed ski support 15 by the localized irregularity exceeds the spacing between the upper and lower limiting stops, then the bottom 29 of the respective ski section 13 is forced upwardly by such excess displacement, which does affect the elevation of the averaging ski 11 and, therefor, enters into the averaging effect of the averaging ski 11. The greater the number of the ski supports 15 perturbed by the same or a different localized irregularity, then the greater the tendency that the elevation of the averaging ski 11 will be affected by the localized irregularities.

Carried further, the overall interaction of the plurality of ski supports 15 of the end-to-end connected ski sections 13 with the underlying subgrade and localized irregularities thereof determines the operable elevation of the averaging ski 11 as it is displaced longitudinally in the direction that the paver 3 is moving, as indicated by the arrow designated by the arrow 31 if FIG. 2. The greater the deflection of any particular one of the ski supports 15, the greater the influence of that particular one of the ski supports 15 on the averaging effect of the averaging ski 11.

The averaging ski 11 is connected alongside and substantially parallel to the direction of travel 31 of the paver 3 by connecting means 33, such as those shown in FIG. 2. The connecting means 33 generally include a front crossrod 35 and a rear crossrod 37. Preferably, each of the crossrods 35 and 37 is extendable outwardly from either side of the paver 3 whereby the averaging ski 11 can be used on either the right-hand side of the paver 3, as shown in FIG. 1, or the left-hand side.

The connecting means 33 includes an arm 39 connected to the end of the front crossrod 35 that is closer to the averaging ski 11, a ski connector 41, and a spanner 43 pivotally connected between the arm 39 and the ski connector 41, such that the averaging ski 11 can be displaced vertically relative to the front crossrod 35 as the averaging ski 11 is responsively displaced along the subgrade and the localized irregularities as hereinbefore described and as suggested in FIG. 2.

Similarly, another portion of the connecting means 33, includes an arm 40, a ski connector 42, and a spanner 44 pivotally connecting the rear crossrod 37 to the averaging ski 11 such that the averaging ski 11 is maintained substantially parallel to the direction of travel 31 of the paver 3. Preferably, the arms 39 and 40 of the connecting means 33 are sufficiently laterally spaced from the averaging ski 11 such that lower extremities of the arms 39 and 40 may be operably and non-interferingly spaced above, at, or below a top 45 of the averaging ski 11, if necessary.

The surface control means 7 includes a grade controller 47, a grade control wand 49, and a cam 51 generally spaced substantially parallel to the averaging ski 11. The grade controller 47 is attached to a screed arm 53 of the paver 3 by vertically and outwardly adjustable support means 54, as shown in FIG. 1. Preferably, the grade control wand 49 is maintained in contact with the cam 51, such as by a suitable connector (not shown) or by a rotational bias that urges the grade control wand 49 against the cam 51, as suggested in FIG. 2.

For purposes of the immediately following discussion, assume that the cam 51 is rigidly mounted relative to the averaging ski 11. With the assumed rigid mounting thereof, the cam 51 is displaced vertically, upwardly and downwardly, in response to similar displacement of the averaging ski 11 as the averaging ski 11 responds to the averaging effects of the plurality of ski supports 15 as the paver 3 moves in the direction of travel 31. Similarly, the cam 51 remains oriented with the longitudinal axis of the averaging ski 11 as the longitudinal axis of the averaging ski 11 is re-oriented in a vertical plane as the averaging ski 11 responds to the averaging effects of the plurality of ski supports 15.

As the cam 51 is dynamically re-oriented and displaced vertically, the grade control wand 49 is correspondingly urged arcuately about a pivot 55 that communicates the displacement of the cam 51 to the grade controller 47. The grade controller 47, in turn, varies the pull point position of a screed 57 of the paver 3 by methods and mechanisms commonly known in the art. By varying the pull point position of the screed 57, the thickness of an asphalt mat 58 being laid by the paver 3, as shown in FIG. 1, is varied accordingly. The grade controller 47 is calibrated whereby the compaction factor of the asphalt material being placed in the mat 58 by the paver 3 is taken into account. In other words, the thickness of the mat 58 is such that the mat 58, after compaction, will have the desired thickness. As the grade control wand 49 is maintained in an equilibrium position, the mat 58 of asphalt material being laid by the paver 3 has a uniform thickness.

As the averaging effects of the ski supports 15 cause the averaging ski 11 and the cam 51 to shift upwardly relative to the positioning of the grade controller 47 on the screed arm 53, however, the grade controller 47 senses such upward shift as a demand for a thicker layer of asphalt material in order to compensate for the operable difference in the elevation of the paver 3 at the location of the grade controller 47 and the elevation of the averaging ski 11 at the location of the interaction between the grade control wand 49 and the cam 51. As a result, the grade controller 47 causes the pull point position of the screed 57 to be altered, thereby correspondingly causing the thickness of the mat 58 being placed by the paver 3 to be increased.

As the thickness of the mat 58 increases, the screed 57 shifts upwardly, rotating the distal end of the screed arm 53 upwardly and correspondingly displacing the grade controller 47 attached to the screed arm 53 upwardly. As the grade controller 47 is displaced upwardly relative to the "new" elevation of the averaging ski 11 as indicated by the interaction between the grade control wand 49 and the cam 51, the orientation of the grade control wand 49 relative to the grade controller 47 is returned to its equilibrium position and the surface of the mat 58 then being laid by the paver 3 will be substantially planar, after compaction, with that of the mat 58, which was laid just prior to the changed averaging effects of the averaging ski 11.

Similarly, as the averaging effects of the ski supports 15 cause the averaging ski 11 and the cam 51 to shift downwardly relative to the positioning of the grade controller 47 on the screed arm 53, the grade controller 47 causes the pull point position of the screed 57 to be altered whereby the thickness of the mat 58 being placed by the paver 3 is decreased. As the thickness of the mat 58 decreases, the screed 57 shifts downwardly, rotating the distal end of the screed arm 53 downwardly and correspondingly displacing the grade controller 47 attached to the screed arm 53 downwardly. As the grade controller 47 is displaced downwardly relative to the averaging ski 11, the positioning of the grade control wand 49 is returned to its equilibrium position and the surface of the mat 58 then being laid by the paver 3 will be substantially planar, after compaction, with the mat 58 which was laid just prior to those changed averaging effects of the averaging ski 11.

In other words, the averaging ski 11 provides the necessary averaging needed to provide a compacted mat, after compaction, that exhibits the general profile of the terrain over which the paving is being laid as indicated by the averaging which occurs over the length of the averaging ski 11. The averaging ski 11, however, does not properly compensate for subgrade deviations having longitudinal dimensions that are less than the length of the averaging ski 11 and does not, therefore, eliminate differential compaction. As a result, such a surface may, after compaction, provide a very rough ride.

Now, for the following discussion concerning the compaction compensating means 9, which eliminates the effects of differential compaction, the cam 51 is no longer considered to be rigidly mounted relative to the averaging ski 11 as previously assumed but, instead, is mounted as hereinafter described.

The compaction compensating means 9 includes a compensating ski 59, a cam shaft 61, and a sensor wand 63, as shown in FIG. 3. Preferably, the length of the compensating ski 59 is short enough whereby differential compaction arising from localized subgrade fluctuations, which are shorter than the averaging ski 11, are eliminated. Freshly laid asphalt has a limited amount of displacement mobility while it is being compacted, generally a few feet at most. Preferably, the length of the compensating ski 59 is greater than, but on the order of, the displacement mobility of the asphalt material being placed by the paver 3. Thus, the compensating ski 59 has a length that is generally approximately six to ten feet in length. In many applications, one of the ski sections 13 can be used for the compensating ski 59.

As with one of the ski sections 13, the compensating ski 59 is mounted on two or more sliding or rolling ski supports 65, such as the multi-footed arrangement shown in FIG. 1. For example, the compensating ski 59 may have four of the ski supports 65.

Each of the ski supports 65 shown in FIG. 2 has a shoe 67, a pair of opposing shoe brackets 69 attached to the shoe 67, a pair of opposing support brackets 71 attached to the compensating ski 59, and an offset portion 73 pivotally connected near each end thereof to either the pair of shoe brackets 69 or the pair of support brackets 71.

Each of the ski supports 65 is spring loaded (not shown), which permits the shoe 67 thereof to be generally vertically displaced between upper and lower limiting stops (not shown). Normally, each of the shoes 67 is biased downwardly a selected distance from a bottom 75 of the compensating ski 59 against the respective lower limiting stop thereof.

As a single one of the ski supports 65 encounters a localized irregularity in the subgrade, such as an exposed rock or the like, the perturbed ski support 65 is urged upwardly toward the upper limiting stop against the downward bias thereof. If the spacing between the upper and lower limiting stops is greater than the amount of displacement of the perturbed ski support 65 caused by the localized irregularity, then the perturbation affects only the perturbed ski support 65 and does not affect the averaging effect of the compensating ski 59 as the downward biasing of a single one of the ski supports 65 is insufficient to affect the elevation of the compensating ski 59.

If, however, the amount of displacement of the ski support 65 perturbed by the localized irregularity exceeds the spacing between the upper and lower limiting stops, then the bottom 75 of the compensating ski 13 is forced upwardly by such excess displacement, which does affect the elevation of the compensating ski 59 and, therefore, does enter into the averaging effect of the compensating ski 11. The greater the number of the ski supports 65 perturbed by the same or a different localized irregularity, then the greater the tendency that the elevation of the compensating ski 11 will be affected by the localized irregularities.

The overall interaction of the plurality of ski supports 65 of the compensating ski 59 with the underlying subgrade and localized irregularities thereof determines the operable elevation of the compaction compensating ski 59 as it is displaced longitudinally in the direction 31 that the paver 3 is traveling. The greater the deflection of any particular one of the ski supports 65, the greater the influence of that particular one of the ski supports 65 on the averaging effect of the compensating ski 59.

The compensating ski 59 is connected alongside and substantially parallel to the averaging ski 11 by connecting means 77, such as those shown in FIGS. 2. The connecting means 77 include a leading ski connector 79, a trailing ski connector 81, and a spanner 83 pivotally connected between the leading ski connector 79 and the trailing ski connector 81, such that the compensating ski 59 can be displaced vertically relative to the averaging ski 11 as the compensating ski 59 is responsively displaced relative to the subgrade and the localized irregularities as hereinbefore described.

Similarly, another portion of the connecting means 77 includes a leading ski connector 80, a trailing ski connector 82, and a spanner 84 pivotally connecting the trailing end of the compensating ski 59 to the averaging ski 11 such that the compensating ski 59 is maintained generally parallel to the direction of travel 31 of the paver 3. Preferably, the connecting means 77 are adapted to permit either or both ends of the compaction compensating ski 59 to operably and non-interferingly assume an elevation either above, at, or below that of the elevation of the averaging ski 11 adjacent thereto.

If necessary, the pivotal connection provided by one or both of the trailing ski connectors 81 and 82 and the respective spanners 83 and 84 may be elongated longitudinally along the compensating ski 59 to allow for varying horizontal spacing between the two spanners 83 and 84 as the orientation of the compensating ski 59 varies from the orientation of the averaging ski 11.

The cam shaft 61 is pivotally mounted on a cam bracket 85 by a pin 87, such as a bolt and nut, or the like. The cam 51, which is generally spaced substantially parallel to the averaging ski 11 as hereinbefore described, is connected to one end of the cam shaft 61, as shown in FIGS. 2 and 3. The sensor wand 63 is connected to the other end of the cam shaft 61 such that the sensor wand 63 bears against and remains in contact with a top 89 of the compensating ski 59, as shown in FIG. 3.

The cam shaft 61 has a first set 91 of orifices, such as orifices 91*a*, 91*b*, 91*c*, 91*d* and 91*e*, as shown in FIGS. 3 and 4. Similarly, the cam bracket 85 has a second set 93 of orifices, such as orifices 93*a*, 93*b* and 93*c*. Each of the orifices of the sets 91 and 93 are adapted to receive the pin 87 therethrough.

The spacing between the point where the sensor wand 63 contacts the top 89 of the compensating ski 59 and an axis 88 of the cam 51, and the corresponding spacing between the axis 88 and a selected one of the orifice set 91, such as the orifice 91*c*, is adapted to provide an appropriate increase or decrease in the thickness of the mat 58 based upon the compaction factor of the asphalt material being laid by the paver 3. The formula which describes such spacings is as follows:

$$X = L\left(\frac{K}{1-K}\right)$$

where "X" is the spacing of a selected one of the orifice set 91 from the axis 88 for a particular compaction factor, "K" is the compaction factor, and "L" is the spacing between the sensor wand 63 and the axis 88.

For example, if the asphalt has a compaction factor of twenty percent, the pin 87 is inserted through the orifice 91*c* and through one of the orifices of the set 93 such that the cam shaft 61 pivots about the orifice 91*c* and the sensor wand 63 bears against the top 89. Similarly, if the asphalt has a compaction factor of thirty percent, the pin 87 is inserted through the orifice 91*e* and through one of the orifices of the set 93 such that the cam shaft 61 pivots about the orifice 91*e*, etc. Locations of the orifice set 91 for various compaction factors are shown in FIG. 4. The orifice set 93 provides a plurality of orifices for selectively receiving the pin 87 whereby the contact point between the sensor wand 63 and the top 89 is not spaced too closely to either edge of the top 89.

It is to be understood that, instead of being supported by the underlying subgrade, the averaging ski 11 may be supported by the surface of previously laid asphalt if the paver 3 is being used to construct a "match joint" with such previously laid asphalt. For such applications, the compensating ski 59 is spaced between the averaging ski 11 and the paver 3. The cam shaft 61 is connected to the averaging ski 11 by the cam bracket 85 as hereinbefore described, but with the cam shaft 61 reversed end for end such that the sensor wand 63 is displaced toward the paver 3 and resting against the top 89 of the compensating ski 59. In that event, the grade control wand 49 must be lengthened or the grade controller 47 must be positioned by the support means 54 whereby the grade control wand 49 rests against the cam 51 as hereinbefore described and as shown in FIG. 5.

A first modified compaction compensating system for an asphalt paver in accordance with the present invention is shown in FIG. 6 and is generally designated by the reference numeral 101. Many of the characteristics of the first modified compaction compensating system 101 are substantially similar to those previously described for the compaction compensating system 1 and will not be reiterated here in detail. Herein, like elements are generally designated by the same element numbers for purposes of uniformity.

The compaction compensating system 101 for an asphalt paver 3 includes surface reference means 5, surface control means 7, and compaction compensating means 9, including the compensating ski 59.

The surface reference means 5 include a stringline 103 that is located and supported by a plurality of stringline stakes, such as stringline stakes 105 and 107 as shown in FIG. 6. The compensating ski 59 is connected alongside and substantially parallel to the direction of travel 31 of the paver 3 by connecting means 33, as shown in FIG. 6. The surface control means 7 includes the grade controller 47, the grade control wand 49, the cam 51, and a stringline cam 109. The grade controller 47 is attached to the screed arm 53 of the paver 3 by the vertically and outwardly adjustable support means 54, as shown in FIG. 6. Preferably, the grade control wand 49 is maintained in contact with the cam 51, such as by a suitable connector (not shown) or by a rotational bias that urges the grade control wand 49 against the cam 51, and the stringline cam 109 is maintained in contact with the stringline 103.

For purposes of the immediately following discussion, assume that the elevation of the compensating ski 59 relative to the elevation of the stringline 103 remains constant. Then, the cam 51 is displaced vertically, upwardly and downwardly, in response to corresponding changes in the elevation of the stringline 103 relative to the elevation of the paver 3 as the paver 3 moves in the direction of travel 31.

As the cam 51 is dynamically displaced vertically, the grade control wand 49 correspondingly communicates the displacement of the cam 51 to the grade controller 47. The grade controller 47, in turn, varies the pull point position of the screed 57 of the paver 3 as hereinbefore described.

Now, for the following discussion concerning the compaction compensating means 9, assume that the elevation of the compensating ski 59 no longer remains constant relative to the elevation of the stringline 103 but, instead, varies as a result of interaction of the compensating ski 59 with the localized irregularities of the subgrade as hereinbefore described. The compaction compensating means 9 includes a cam shaft 111, as shown in FIG. 6. The cam shaft 111 is pivotally mounted on a cam bracket 113, such as by a bolt and nut, or the like. The cam 51 and the stringline cam 109 are generally spaced substantially perpendicular to the compensating ski 59, as shown in FIG. 6. The cam shaft 111 has a set of orifices that are spaced to provide an appropriate increase or decrease in the thickness of the asphalt mat being laid by the paver 3, the spacing being based upon the compaction factor of the asphalt material similar to that hereinbefore described in regard to the cam shaft 61.

A second modified compaction compensating system for an asphalt paver in accordance with the present invention is shown in FIG. 7 and is generally designated by the reference numeral 141. Many of the characteristics of the second modified compaction compensating system 141 are substantially similar to those of other compaction compensating systems of the present invention previously described herein and will not be reiterated here in detail.

The compaction compensating system 141 for an asphalt paver 3 includes surface reference means 5, surface control means 7, and compaction compensating means 9. The surface reference means 5 include the averaging ski 11. The averaging ski 11 is connected alongside and substantially parallel to the direction of travel 31 of the paver 3 by connecting means 33. The surface control means 7 includes a non-contacting sensor 143, such as an ultrasonic sensor as commonly known and used in the art for ranging purposes; see, for example, U.S. Pat. No. 5,301,170 entitled ULTRASONIC SENSOR MOUNTING DEVICE, issued Apr. 5, 1994 to Richard W. James. The sensor 143 is attached to the screed arm 53 of the paver 3 by adjustable support means 54, as shown in FIG. 7. The sensor 143 is positioned such that a beam 145 therefrom is focussable on a top 147 of the averaging ski 11, as shown in FIG. 7.

As the paver 3 moves in the direction of travel 31 and the averaging ski 11 responds to the averaging effects of the plurality of ski supports 15, the screed 57 is appropriately displaced vertically, upwardly and downwardly, by screed control 149, shown schematically in FIG. 7, in response to the corresponding ranging signals communicated by the sensor 143, as adjusted to compensate for the compaction factor of the asphalt paving being laid by the paver 3.

The compaction compensating means 9 includes the compensating ski 59 and a second non-contacting sensor 151, as shown in FIG. 7. The compensating ski 59 is connected alongside and substantially parallel to the averaging ski 11 by connecting means 77. The sensor 151 is attached to the screed arm 53 of the paver 3 by the adjustable support means 54, as shown in FIG. 7. The sensor 151 is positioned such that a beam 153 therefrom is focussable on the top 89 of the compensating ski 59. As the compensating ski 59 is displaced vertically upwardly and downwardly in response to the localized irregularities in the subgrade as hereinbefore described, the resulting ranging change, as adjusted to compensate for the compaction factor of the asphalt paving being laid by the paver 3, is communicated by the sensor 151 to the screed control 149, which change is added or subtracted, as appropriate, from the signal being received from the sensor 143 and the pull point of the screed 57 is modified accordingly. It is to be understood that, relative to the paver 3, the compensating ski 59 may be spaced inwardly or outwardly from the averaging ski 11.

A third modified compaction compensating system for an asphalt paver in accordance with the present invention is shown in FIG. 8 and is generally designated by the reference numeral 171. Many of the characteristics of the third modified compaction compensating system 171 are substantially similar to those of other compaction compensating systems of the present invention previously described herein and will not be reiterated here in detail.

The compaction compensating system 171 for an asphalt paver 3 includes surface reference means 5, surface control means 7, and compaction compensating means 9, including the compensating ski 59.

The surface reference means 5 include the stringline 103 that is located and supported by a plurality of stringline stakes, such as the stringline stakes 105 and 107 as shown in FIG. 8. The compensating ski 59 is connected alongside and substantially parallel to the direction of travel 31 of the paver 3 by connecting means 33, as shown in FIG. 8. The surface control means 7 includes the stringline 103 and a non-contacting sensor 173. The sensor 173 is attached to the screed arm 53 of the paver 3 by adjustable support means 54, as shown in FIG. 8. The sensor 173 is positioned such that a beam 175 therefrom is focussable such that ranging of the stringline 103 therefrom is determinable thereby.

For purposes of the immediately following discussion, assume that the elevation of the compensating ski 59 relative to the elevation of the stringline 103 remains constant. As the paver 3 moves in the direction of travel 31 and the sensor 173 signals ranging changes relative to the stringline 103, as adjusted to compensate for the compaction factor of the asphalt paving being laid by the paver 3, to the screed control 149, as shown schematically in FIG. 8, the screed 57 is appropriately displaced vertically upwardly and downwardly.

Now, for the following discussion concerning the compaction compensating means 9, assume that the elevation of the compensating ski 59 no longer remains constant relative to the elevation of the stringline 103 but, instead, varies as a result of interaction of the compensating ski 59 with the localized irregularities of the subgrade as hereinbefore described. The compaction compensating means 9 includes a second non-contacting sensor 177, as shown in FIG. 8. The sensor 177 is attached to the screed arm 53 of the paver 3 by the adjustable support means 54, as shown in FIG. 8. The sensor 177 is positioned such that a beam 179 therefrom is focussable on the top 89 of the compensating ski 59. As the compensating ski 59 is displaced vertically upwardly and downwardly in response to the localized irregularities in the subgrade as hereinbefore described, the resulting ranging change, as adjusted to compensate for the compaction factor of the asphalt paving being laid by the paver 3, is communicated by the sensor 177 to the screed control 149, which change is added or subtracted, as appropriate, from the signal being received from the sensor 173 and the pull point of the screed 57 is modified accordingly.

It is to be understood that the compaction compensating system is readily adaptable to applications other than screeds, pavers, and other asphalt equipment and yet remain within the scope and spirit of the present invention.

It is also to be understood that while certain forms of the present invention have been illustrated and described herein, it is not to be limited to the specific forms or arrangement of parts described and shown.

What is claimed and desired to be secured by Letters Patent is as follows:

1. A method for placing a mat of asphalt material on a subgrade having localized irregularities with an asphalt paver and a screed having a variable pull point, said method comprising the steps of:

(a) determining the general profile of the subgrade;

(b) establishing a nominal surface profile of the mat of asphalt material to be placed by the paver after compaction of the mat;

(c) determining the vertical and longitudinal extent of the localized irregularities of the subgrade relative to the general profile of the subgrade; and (d) varying the pull point in response to inputs from step (a) and step (c) in order to adjust the thickness of the mat of asphalt material placed by the paver such that the mat will have the nominal surface profile after compaction of the mat.

2. A method for placing a mat of asphalt material on a subgrade having localized longitudinal deviations with an asphalt paver and a screed having an adjustable pull point, said method comprising the steps of:

(a) establishing a nominal surface profile of the mat of asphalt material to be placed by the paver after compaction of the mat;

(b) detecting the localized longitudinal deviations of the subgrade; and (c) adjusting the pull point of the screed in response to the detecting of the localized longitudinal deviations of the subgrade in order to modify the thickness of the mat of asphalt material placed by the paver such that the mat will have the nominal surface profile after compaction of the mat.

3. The method according to claim 2, wherein said step of establishing a nominal surface profile of the mat of asphalt material includes the use of an averaging ski connected to the paver.

4. The method according to claim 3, wherein said step of detecting the localized longitudinal deviations of the subgrade includes the use of a compensating ski connected to said averaging ski.

5. The method according to claim 4, wherein said step of detecting the localized longitudinal deviations of the subgrade further includes the use of a cam shaft pivotally mounted on said averaging ski, said cam shaft having a sensor wand responsive to said compensating ski.

6. The method according to claim 2, wherein said step of establishing a nominal surface profile of the mat of asphalt material includes the use of an averaging ski connected to the paver wherein the averaging ski has a length substantially greater than a length of the paver.

7. The method according to claim 2, wherein said step of establishing a nominal surface profile of the mat of asphalt material includes the use of an averaging ski connected to the paver wherein the averaging ski has a length of approximately forty feet.

8. The method according to claim 2, wherein said step of establishing a nominal surface profile of the mat of asphalt material includes the use of an averaging ski connected to the paver wherein the averaging ski comprises a plurality of multi-footed ski sections.

9. The method according to claim 2, wherein said step of establishing a nominal surface profile includes the use of an averaging ski connected to the paver wherein said averaging ski comprises a plurality of multi-footed ski sections, each having a length of approximately ten feet.

10. The method according to claim 2, wherein said step for detecting the localized longitudinal deviations of the subgrade includes the use of a compensating ski.

11. The method according to claim 2, wherein said step for detecting the localized longitudinal deviations of the subgrade includes the use of a compensating ski having a multi-footed ski section.

12. The method according to claim 2, wherein said step of establishing a nominal surface profile of the mat of asphalt material includes the use of a stringline.

13. A method for placing a mat of asphalt material on a subgrade having localized longitudinal deviations with an asphalt paver and a screed having an adjustable pull point, said method comprising the steps of:

(a) establishing a nominal surface of the mat of asphalt material to be placed by the paver, including the use of an averaging ski connected to the paver;

(b) detecting the localized longitudinal deviations of the subgrade, including the use of a compensating ski connected to said averaging ski wherein said compensating ski is spaced between said averaging ski and the paver; and (c) adjusting the pull point of the screed in response to the detecting of the localized longitudinal deviations of the subgrade in order to modify the nominal surface such that differential compaction is substantially eliminated from the mat of asphalt material being placed by the paver after compaction of the mat.

14. A method for placing a mat of asphalt material on a subgrade having localized longitudinal deviations with an asphalt paver and a screed having an adjustable pull point, said method comprising the steps of:

(a) establishing a nominal surface of the mat of asphalt material to be placed by the paver, including the use of an averaging ski connected to the paver;

(b) detecting the localized longitudinal deviations of the subgrade, including the use of a compensating ski connected to said averaging ski wherein said averaging ski is spaced between said compensating ski and the paver; and (c) adjusting the pull point of the screed in response to the detecting of the localized longitudinal deviations of the subgrade in order to modify the nominal surface such that differential compaction is substantially eliminated from the mat of asphalt material being placed by the paver after compaction of the mat.

15. A method for placing a mat of asphalt material on a subgrade having localized longitudinal deviations with an asphalt paver and a screed having an adjustable pull point, said method comprising the steps of:

(a) establishing a nominal surface of the mat of asphalt material to be placed by the paver, including the use of an averaging ski connected to the paver;

(b) detecting the localized longitudinal deviations of the subgrade, including the use of a compensating ski connected to said averaging ski and further includes the use of a cam shaft pivotally mounted on said averaging ski, wherein said cam shaft has a sensor wand responsive to said compensating ski; and (c) adjusting the pull point of the screed in response to the detecting of the localized longitudinal deviations of the subgrade in order to modify the nominal surface such that differential compaction is substantially eliminated from the mat of asphalt material being placed by the paver after compaction of the mat, including providing said cam shaft with a plurality of settings corresponding to different compaction factors of the asphalt material being placed by the paver.

16. A method for placing a mat of asphalt material on a subgrade having localized longitudinal deviations with an asphalt paver and a screed having an adjustable pull point, said method comprising the steps of:

(a) establishing a nominal surface of the mat of asphalt material to be placed by the paver, including the use of an averaging ski connected to the paver and a first non-contacting sensor responsive to said averaging ski;

(b) detecting the localized longitudinal deviations of the subgrade, including the use of a compensating ski connected to said averaging ski and a second non-contacting sensor responsive to said compensating ski; and (c) adjusting the pull point of the screed in response to the detecting of the localized longitudinal deviations of the subgrade in order to modify the nominal surface such that differential compaction is substantially eliminated from the mat of asphalt material being placed by the paver after compaction of the mat.

17. A method for placing a mat of asphalt material on a subgrade having localized longitudinal deviations with an asphalt paver and a screed having an adjustable pull point, said method comprising the steps of:

(a) establishing a nominal surface of the mat of asphalt material to be placed by the paver, including the use of an averaging ski connected to the paver and a first non-contacting sensor responsive to a stringline;

(b) detecting the localized longitudinal deviations of the subgrade, including the use of a compensating ski connected to said averaging ski and a second non-contacting sensor responsive to said compensating ski; and (c) adjusting the pull point of the screed in response to the detecting of the localized longitudinal deviations of the subgrade in order to modify the nominal surface such that differential compaction is substantially eliminated from the mat of asphalt material being placed by the paver after compaction of the mat.

* * * * *